US005330545A

United States Patent [19]

Lewtas et al.

[11] Patent Number: 5,330,545

[45] Date of Patent: Jul. 19, 1994

[54] MIDDLE DISTILLATE COMPOSITION WITH IMPROVED COLD FLOW PROPERTIES

[75] Inventors: Kenneth Lewtas, Wantage; Kenneth W. Bartz, Abingdon, both of United Kingdom

[73] Assignee: Exxon Chemical Patents Inc., Linden, N.J.

[21] Appl. No.: 997,403

[22] Filed: Dec. 28, 1992

Related U.S. Application Data

[63] Continuation of Ser. No. 876,244, Apr. 30, 1992, abandoned, which is a continuation of Ser. No. 303,593, Jan. 27, 1989, abandoned, which is a continuation of Ser. No. 901,216, Aug. 28, 1986, abandoned.

[30] Foreign Application Priority Data

Aug. 28, 1985 [GB] United Kingdom ..... 85-21392

[51] Int. Cl.[5] ..... C10L 1/18

[52] U.S. Cl. ..... 44/395; 44/389; 44/393

[58] Field of Search ..... 44/395, 393, 389

[56] References Cited

U.S. PATENT DOCUMENTS

| | | | |
|---|---|---|---|
| 3,048,479 | 8/1962 | Ilnyckyj et al. | 44/62 |
| 3,413,103 | 11/1968 | Young et al. | 44/62 |
| 3,961,916 | 6/1976 | Ilnyckyj et al. | 44/62 |
| 4,211,534 | 7/1980 | Feldman | 44/62 |

FOREIGN PATENT DOCUMENTS 1469016 3/1977 United Kingdom .

OTHER PUBLICATIONS

Journal of the Institute of Petroleum vol. 52, No. 510, Jun. 1966, pp. 173–185.

*Primary Examiner*—Ellen M. McAvoy
*Attorney, Agent, or Firm*—V. T. White

[57] ABSTRACT

The cold flow properties of distillate petroleum fuel are improved by adding a polymer or copolymer containing at least 25 wt. % of an n-alkyl ester of the general formula

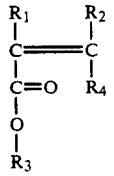

wherein $R_1$ and $R_2$ are hydrogen or a $C_1$ alkyl group, e.g., methyl, $R_4$ is $COOR_3$, hydrogen or a $C_1$ to $C_4$ alkyl group preferably $COOR_3$ and $R_3$ has an average number of carbon atoms from 12 to 20 and contains a methyl branch at the 1 and/or 2 position.

13 Claims, No Drawings

MIDDLE DISTILLATE COMPOSITION WITH IMPROVED COLD FLOW PROPERTIES

This application is a Rule 60 continuation of U.S. Ser. No. 07/876,244 filed on Apr. 30, 1992, now abandoned, which is a Rule 60 continuation of U.S. Ser. No. 07/303,593 filed on Jan. 27, 1989, now abandoned, which is a Rule 60 continuation of U.S. Ser. No. 06/901,216 filed on Aug. 28, 1986, now abandoned.

Mineral oils containing paraffin wax have the characteristic of becoming less fluid as the temperature of the oil decreases. This loss of fluidity is due to the crystallization of the wax into plate-like crystals which eventually form a spongy mass entrapping the oil therein.

It has long been known that various additives act as wax crystal modifiers when blended with waxy mineral oils. These compositions modify the size and shape of wax crystals and reduce the adhesive forces between the crystals and between the wax and the oil in such a manner as to permit the oil to remain fluid at a lower temperature.

Various pour point depressants have been described in the literature and several of these are in commercial use. For example, U.S. Pat. No. 3,048,479 teaches the use of copolymers of ethylene and $C_3$–$C_5$ vinyl esters, e.g. vinyl acetate, as pour depressants for fuels, specifically heating oils, diesel and jet fuels. Hydrocarbon polymeric pour depressants based on ethylene and higher alpha-olefins, e.g., propylene, are also known. U.S. Pat. No. 3,961,916 teaches the use of a mixture of copolymers, one of which is a wax crystal nucleator and the other a growth arrestor to control the size of the wax crystals.

United Kingdom Patent 1263152 suggests that the size of the wax crystals may be controlled by using a copolymer having a lower degree of side chain branching.

It has also been proposed in for example United Kingdom Patent 1469016 that the copolymers of di-n-alkyl fumarates and vinyl acetate which have previously been used as pour depressants for lubricating oils may be used as co-additives with ethylene/vinyl acetate copolymers in the treatment of distillate fuels with high final boiling points to improve their low temperature flow properties. According to United Kingdom Patent 1469016 these polymers may be $C_6$ to $C_{18}$ alkyl esters of unsaturated $C_4$ to $C_8$dicarboxylic acids particularly lauryl fumarate and lauryl-hexadecyl fumarate. Typically the materials used are esters with an average of about 12 carbon atoms (Polymer A). It is notable that the additives are shown not to be effective in the "conventional" fuels of lower Final Boiling Point (Fuels III and IV).

With the increasing diversity in distillate fuels, types of fuel have emerged which cannot be treated by the existing additives or which require an uneconomically high level of additive to achieve the necessary reduction in their pour point and control of wax crystal size for low temperature filterability to allow them to be used commercially. One particular group of fuels that present such problems are those which have a relatively narrow, and/or low boiling range. Another type of fuel difficult to treat are those with high final boiling points and yet another are the high wax content fuels typically found in the far east. Fuels are frequently characterised by their Initial Boiling Point, Final Boiling Point and the interim temperatures at which certain volume percentages of the initial fuel have been distilled. Fuels whose 20% to 90% distillation point differ within the range of from 70° to 100° C. and/or whose 90% boiling temperature is from 10° to 25° C. of the final boiling point and/or whose final boiling points are between 340° and 370° C. are generally considered narrow boiling fuels and can be particularly difficult to treat sometimes being virtually unaffected by additives or otherwise requiring very high levels of additive. Fuels having final boiling points above 370° C. are sometimes known as high final boiling fuels and are also difficult to treat. All distillations referred to herein are according to ASTM D86.

With the increase in the cost of crude oil, it has also become important for a refiner to increase his production of distillate fuels and to optimise his operations using what is known as sharp fractionation again resulting in distillate fuels that are difficult to treat with conventional additives or that require a treat level that is unacceptably high from the economic standpoint. Typical sharply fractionated fuels also have a 90% to final boiling point range of 10° to 25° C. usually with a 20 to 90% boiling range of less than 100° C., generally 50° to 100° C. Both types of fuel have final boiling points above 340° C. generally a final boiling point in the range 340° C. to 370° C. especially 340° C. to 365° C.

In addition there is at times a need to lower what is known as the cloud point of distillate fuels; the cloud point being the temperature at which the wax begins to crystallise out from the fuel as it cools. This need is applicable to both the difficult to treat fuels described above and the entire range of distillate fuels which typically boil in the range 120° C. to 500° C.

The copolymers of ethylene and vinyl acetate which have found widespread use for improving the flow of the previously widely available distillate fuels have not been found to be effective in the treatment of the narrow boiling and/or sharply fractionated fuel described above. Furthermore use of mixtures as illustrated in United Kingdom Patent 1469016 have not been found effective.

In our European Patent Applications 85301047.8, 85301048.7, 85301675.6 and 85301676.4, we claim that copolymers containing very specific alkyl groups, such as specific n-alkyl fumarate/vinyl acetate copolymers, are effective in both lowering the pour point of the difficult to treat fuels described above and controlling the size of the wax crystals to allow filterability including those of the lower final boiling point in which the additives of United Kingdom Patent 1469016 were ineffective. We claim in these Applications that these copolymers are effective in lowering the cloud point of many fuels over the entire range of distillate fuels.

We have now found that although if one uses relatively highly branched fumarate ester they are not effective additives the presence of a methyl branch on the alkyl chain in the 1 or 2 position in the alkyl group does not detract from their performance as an additive and can have economic and performance benefits.

The present invention therefore provides the use for improving the flow properties of a distillate petroleum fuel oil boiling in the range 120° C. to 500° C. of an additive comprising a polymer or copolymer containing at least 25 wt. % of an alkyl ester of the general formula

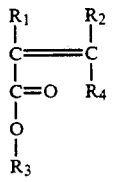

wherein $R_1$ and $R_2$ are hydrogen or a $C_1$ alkyl group, e.g., methyl, $R_4$ is $COOR_3$, hydrogen or a $C_1$ to $C_4$ alkyl group preferably $COOR_3$ and $R_3$ has an average number of carbon atoms from 12 to 20 and contains a methyl branch at the 1 and/or 2 position and the ester polymer or copolymer contains no more than 10 wt. % of ester monomer containing alkyl Groups containing more than 20 carbon atoms and preferably no more than 20 wt. % of ester monomer in which the alkyl group contains fewer than 12 carbon atoms.

The composition of $R_3$ may vary within the polymer structure and some of the $R_3$ groups may be n-alkyl but no more than 10 wt. % should contain more branches than the methyl groups at the 1 and/or 2 position. The additives are preferably used in an amount from 0.0001 to 0.5 wt. %, based on the weight of the distillation petroleum fuel oil, and the present invention also includes such treated distillate fuel.

The copolymer may be of a di-n alkyl ester of a dicarboxylic and may also contain from 25 to 70 wt. % of a vinyl ester, an alkyl acrylate, methacrylate or alpha olefin.

The polymers used in the present invention preferably have a number average molecular weight in the range of 1000 to 100,000, preferably 1,000 to 30,000 as measured, for example, by Vapor Pressure Osmometry. The esters used to make the copolymers may be prepared by esterifying the particular mono-or di-carboxylic acid with the appropriate alcohol or mixture of alcohols. Examples of other unsaturated esters, are the alkyl acrylates and methacrylates.

The dicarboxylic acid mono and all-ester monomers may be copolymerized with various amounts, e.g., 5 to 70 mole %, of other unsaturated esters or olefins. Such other esters include short chain alkyl esters having the formula:

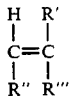

where R' is hydrogen or a $C_1$ to $C_4$ alkyl group, R''1 is —COOR'''' or —OOCR'''' where R'' is a $C_1$ to $C_5$ alkyl group branched or unbranched, and R''' is R'' or hydrogen. Examples of these short chain esters are methacrylates, acrylates, fumarates and maleares, the vinyl esters such as vinyl acetate and vinyl propionate being preferred. More specific examples include methyl methacrylate, isopropenyl acetate and butyl and isobutyl acrylate.

Our preferred copolymers contain from 40 to 60 mole % of a dialkyl fumarate and 60 to 40 mole % of vinyl acetate.

The preferred ester polymers are Generally prepared by polymerising the ester monomers in a solution of a hydrocarbon solvent such as heptane, benzene, cyclohexane, or white oil, at a temperature generally in the range of from 20° C. to 150° C. and usually promoted with a peroxide or azo type catalyst, such as benzoyl peroxide or azodiisobutyronitrile, under a blanket of an inert gas such as nitrogen or carbon dioxide, in order to exclude oxygen.

The additives of the present invention are particularly effective when used in combination with other additives known for improving the cold flow properties of distillate fuels generally, although they may be used on their own to impart a combination of improvements to the cold flow behaviour of the fuel.

The additives of the present invention are particularly effective when used with the polyoxyalkylene esters, ethers, ester/esters and mixtures thereof, particularly those containing at least one preferably at least two $C_{10}$ to $C_{30}$ linear saturated alkyl groups and a polyoxyalkylene glycol group of molecular weight 100 to 5,000 preferably 200 to 5,000, the alkyl group in said polyoxyalkylene glycol containing from 1 to 4 carbon atoms. These materials form the subject of European Patent Publication 0061895 A2.

The preferred esters, ethers or ester/ethers useful in the present invention may be structurally depicted by the formula:

$$R—O—(A)—O—R^1$$

where R and $R^1$ are the same or different and are preferably

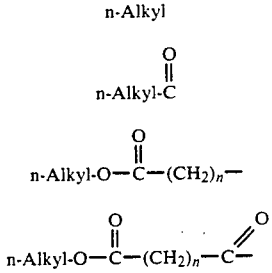

(i) n-Alkyl (ii) n-Alkyl-C(=O)

(iii) n-Alkyl-O—C(=O)—$(CH_2)_n$— n-Alkyl-O—C(=O)—$(CH_2)_n$—C(=O)— the alkyl group being linear and saturated and containing 10 to 30 carbon atoms, and A represents the polyokyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be tolerated it is preferred that the glycol should be substantially linear.

Suitable glycols generally are the substantially linear polyethylene glycols (PEG) and polypropylene glycols (PPG) having a molecular weight of about 100 to 5,000 preferably about 200 to 2,000. Esters are preferred and fatty acids containing from 10–30 carbon atoms are useful for reacting with the glycols to form the ester additives and it is preferred to use a $C_{18}$–$C_{24}$ fatty acid, especially behenic acids, the esters may also be prepared by esterifying polyethoxylated fatty acids or polyethoxylated alcohols.

Polyoxyalkylene diesters, diethers, ether/esters and mixtures thereof are suitable as additives with diesters preferred for use in narrow boiling distillates whilst minor amounts of monoethers and monoesters may also be present and are often formed in the manufacturing process it is important for additive performance that a major amount of the dialkyl compound is present. In particular stearic or behenic diesters of polyethylene glycol, polypropylene glycol or polyethylene/polypropylene glycol mixtures are preferred.

The additives of this invention may also be used with the ethylene unsaturated ester copolymer flow improvers. The unsaturated monomers which may be copolymerized with ethylene, include unsaturated mono and diesters of the general formula:

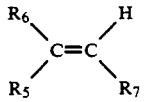

wherein $R_6$ is hydrogen or methyl a $R_5$ is a —$OOCR_8$ group wherein $R_8$ is hydrogen or a $C_1$ to $C_{28}$, more usually $C_1$ to $C_{17}$, and preferably a $C_1$ to $C_8$, straight or branched chain alkyl group; or $R_5$ is a —$COOOR_8$ group wherein $R_8$ is as previously described but is not hydrogen and $R_7$ is hydrogen or —$COOR_8$ as previously defined. The monomer, when $R_5$ and $R_7$ are hydrogen and $R_5$ is —$OOCR_8$, includes vinyl alcohol esters of $C_1$ to $C_{29}$, more usually $C_1$ to $C_{18}$, monocarboxylic acid. Examples of vinyl esters which may be copolymerised with ethylene include vinyl acetate, vinyl propionate and vinyl butyrate and isobutyrate, vinyl acetate being preferred. We prefer that the copolymers contain from 20 to 40 wt. % of the vinyl ester more preferably from 25 to 35 wt. % vinyl ester. They may also be mixtures of two copolymers such as those described in U.S. Pat. No. 3,961,916.

It is preferred that these copolymers have a number average molecular weight as measured by vapor phase osmometry og 1000 to 6000, preferably 1000 to 3000.

The additives of the present invention may also be used in distillate fuels in combination with polar compounds, either ionic or nonionic, which have the capability in fuels of acting as wax crystal growth inhibitors. Polar nitrogen containing compounds have been found to be especially effective when used in combination with the Glycol esters, ethers or ester/ethers and such three component mixtures are within the scope of the present invention. These polar compounds are preferably amine salts and/or amides formed by rection of at least one molar proportion of hydrocarbyl substituted amines with a molar proportion of hydrocarbyl acid having 1–4 carboxylic acid groups or their arthydrides; ester/amides may also be used generally they contain a total of 30 to 300 carbon atoms preferably 50 to 150 carbon atoms. These nitrogen compounds are described in U.S. Pat. No. 4,211,534. Suitable amines are usually long chain $C_{12}$–$C_{40}$ primary, secondary, tertiary or quaternary amines or mixtures thereof but shorter chain amines may be used provided the resulting nitrogen compound is oil soluble and therefore normally containing about 30 to 300 total carbon atoms. The nitrogen compound preferably contains at least one straight chain $C_8$–$C_{40}$ preferably $C_{14}$–$C_{24}$ alkyl segment.

Suitable amines include primary, secondary, tertiary or quaternary, but preferably are secondary. Tertiary and quaternary amines can only form amine salts. Examples of amines include tetradecyl amine, cocoamine, hydrogenated tallow amine and the like. Examples of secondary amines include dioctadecyl amine, methylbehebyl amine and the like. Amine mixtures are also suitable and many amines derived from natural materials are mixtures. The preferred amin is a secondary hydrogenated tallow amine of the formula $HNR_1R_2$ wherein $R_1$ and $R_2$ are alkyl groups derived from hydrogenated tallow fat composed of approximately 4% $C_{14}$, 31% $C_{16}$, 59% $C_{18}$.

Examples of suitable carboxylic acids for preparing these nitrogen compounds (and their anhydrides) include cyclo-hexane dicarboxylic acid, cyclohexene dicarboxylic acid, cyclopentane dicarboxylic acid, dialpha-naphthyl acetic acid, naphthalene dicarboxylic acid and the like. Generally these acids will have about 5–13 carbon atoms in the cyclic moiety. Preferred acids useful in the present invention are benzene dicarboxylic acids such as phthalic acid, ortho-phthalic acid, and tera-phthalic acid. Ortho-phthalic acid or its anhydride is particularly preferred. The particularly preferred amine compound is the amide-amine salt formed by reacting 1 molar portion of phthalic anhydride with 2 molar portions of di-hydrogenated tallow amine. Another preferred compound is the diamide formed by dehydrating this amide-amine salt.

The relative proportions of additives used in the mixtures are from 0.5 to 20 parts by weight of the polymer of the invention containing the n-alkyl groups containing an average of 12 to 18 carbon atoms to 1 part of the other additive or additives, more preferably from 1.5 to 9 parts by weight of the polymer of the invention.

The additive systems of the present invention may be used in any type of distillate petroleium oil boiling in the range 120° C. to 500° C. The preferred average number of carbon atoms in the groups of $R_3$ will depend upon the type of fuel being treated. For example, we find polymers and copolymers in which the backbone (i.e. straight segments) of $R_3$ contains from 12 to 14 carbon atoms (i.e. $R_3$ itself contains 13 to 15 carbon atoms) to be particularly effective in the so called narrow boiling distillates whereas those in which the backbone of $R_3$ contains an average of from 13 to 16 carbon atoms (i.e. $R_3$ itself contains 14 to 17 carbon atoms) are more effective in treating the high final boiling point fuels. The optimum value for $R_3$ may also depend upon whether the polymer is used as the sole additive or in admixture with other additives. We further find that although $R_3$ should be in the range of 12 to 18 carbon atoms for distillate fuels as a whole we prefer that the compound chosen to treat a particular fuel contain a high proportion of alkyl groups having the average number of carbon atoms. For example, where a polymer with a $C_{12}$ to $C_{14}$ backbone is to be used we prefer that it contains no more than 10 wt. % of monomer in which the backbone of $R_3$ contains more than 14 carbon atoms. Similarly when a polymer in which $R_3$ has a $C_{14}$ to $C_{16}$ backbone is to be used we prefer that no more than 10 wt. % of the ester monomer used contains $R_3$ groups with a backbone with fewer than 14 carbon atoms.

The additive systems of the present invention may conveniently be supplied as concentrates for incorporation into the bulk distillate fuel. These concentrates may also contain other additives as required. These concentrates preferably contain from 3 to 75 wt. %, more preferably 3 to 60 wt. %, most preferably 10 to 50 wt. % of the additives preferably in solution in oil. Such concentrates are also within the scope of the present invention.

The present invention is illustrated by the following examples in which the effectiveness of the additives of the present invention as filterability improvers were compared with other similar additives in the response of the oil to the additives Cold Filter Plugging Point Test (CFPP) which is carried out by the procedure described in detail in "Journal of the Institute of Petroleum", Volume 52, Number 510, June 1966, pp. 173–185. This test is designed to correlate with the cold flow of a middle distillate in automotive diesels.

In brief, a 40 ml sample of the oil to be tested is cooled in a bath which is maintained at about −34° C. to give non-linear cooling at about 1° C./min. Periodically (at each one degree Centigrade drop in temperature starting from at least 2° C. above the cloud point) the cooled oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 2 millimetre diameter. The periodic tests are each initiated by applying a vacuum to the upper end of the pipette whereby oil is drawn through the screen up into the pipette to a mark indicating 20 ml of oil. After each successful passage the oil is returned immediately to the CFPP tube. The test is repeated with each one degree drop in temperature until the oil fails to fill the pipette within 60 seconds. This temperature is reported as the CFPP temperature. The difference between the CFPP of an additive free fuel and of the same fuel containing additive is reported as the CFPP depression by the additive. A more effective flow improver gives a greater CFPP depression at the same concentration of additive.

The fuel used in these examples was:

| | | ASTM-D-86 Distillation, °C. | | | | |
|---|---|---|---|---|---|---|
| Cloud Point | Wax Appearance Point | Initial Boiling Point | 20% | 50% | 90% | Final Boiling Point |
| +3 | +1 | 184 | 226 | 272 | 368 | 398 |

The Additives used were as follows:

Additive 1

A copolymer of a di $C_{16}$ alkyl fumarate obtained by reaction of 2-hexadecanol with fumaric acid and vinyl acetate prepared by solution copolymerisation of a 1 to 1 mole ratio mixture at 80° C. using azo diisobutyronitrile as catalyst in cyclohexane.

Additive 2

A similar copolymer obtained from the commercially available alcohol Dobanol 45 containing primary n $C_{14}$ and $C_{15}$ alcohols but with a small amount of the 2 methyl analogue and for comparison similar alkyl fumarate obtained from $C_{14}$ alcohol, a mixture of n $C_{14}$ and n $C_{16}$ alcohols and n $C_{16}$ alcohol.

The additives were tested in admixture at a 4:1 ratio with an Additive n which was an oil solution containing 63 wt. % of a combination of polymers comprising 3 parts by weight of an ethylene/vinyl acetate copolymer of number average molecular weight 2500 and vinyl acetate content of 36 wt. % and 1 part by weight of a copolymer of ethylene and vinyl acetate of number average molecular weight 3500 and a vinyl acetate content of about 17 wt. %.

The results obtained are as follows:

| Alcohol used in Fumarate/ Vinyl Acetate Copolymer | Reduction in Temp CFPP (C) Additive Treat Rate | |
|---|---|---|
| | 175 ppm | 300 ppm |
| $nC_{14}$ | 17 | 21 |
| Dobanol 45 | 19 | 21 |
| 1-Me $C_{15}$ | 16 | 20 |
| mixed $nC_{14/16}$ | 17 | 19 |
| $nC_{16}$ | 12 | 13 |

The drop in CFPP temperature when using the mixture of ethylene vinyl acetate copolymers above was:

| 175 PPM Treat Rate | 300 PPM Treat Rate |
|---|---|
| 5 | 10 |

In order to further illustrate the invention various blends of an iso $C_{10}$ fumarate/vinyl acetate copolymer and a normal $C_{14}$ fumarate/vinyl acetate copolymer were prepared and evaluated in the fuel previously used in the CFPP test with the following results.

| Blend Composition | | CFPP (°C.) | | | |
|---|---|---|---|---|---|
| | | Alone | | Mixed with EVA III (4:1% weight ratio) | |
| % iso $C_{10}$ | % normal $C_{14}$ | 300 ppm | 500 ppm | 300 ppm | 500 ppm |
| 100 | 0 | 0 | 0 | 4 | 6 |
| 50 | 50 | 0 | 0 | 5 | 6 |
| 30 | 70 | 0 | 0 | 5 | 6 |
| 10 | 90 | 0 | 0 | 13 | 16 |
| 5 | 95 | 0 | 0 | 15 | 17 |
| 4 | 96 | 0 | 0 | 15 | 17 |
| 0 | 100 | 4 | 8 | 17 | 18 |
| 5 | 95 | 0 | 0 | 15 | 16 |

We claim:

1. A distillate petroleum fuel oil boiling in the range of 120° C. to 500° C. containing 0.0001 to 0.5 wt. % additive comprising polyvinylester polymer or copolymer containing at least 25 wt % of repeating n-alkyl ester monomer units represented by the general formula

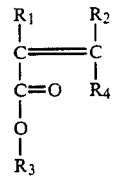

wherein $R_1$ and $R_2$ are hydrogen or methyl, $R_4$ is $COOR_3$, and $R_3$ is independently n-alkyl which (i) has an average number of carbon atoms from 12 to 20, and (ii) contains a methyl branch at the 1 or 2 position, and wherein no more than 10 wt % of the ester monomer units contain alkyl groups containing more than 20 carbon atoms and no more than 20 wt. % of the ester monomer units contain alkyl groups containing fewer than 12 carbon atoms.

2. The distillate petroleum fuel oil according to claim 1 in which the polymer is a copolymer of fumarate ester and vinyl acetate.

3. The distillate petroleum fuel oil according to claim 1 in wherein said polymer or copolymer has a molecular weight of 1,000 to 100,000.

4. A distillate petroleum fuel oil according to claim 1 also containing a polyoxyalkylene ester, ether, or an ester ether.

5. A distillate petroleum fuel oil according to claim 1 also containing an ethylene unsaturated ester copolymer flow improver.

6. The distillate petroleum fuel oil according to claim 1 wherein no more than 10 wt. % of said alkyl groups $R_3$ of said ester monomer units contain more branching than a methyl branch at the 1 or 2 position.

7. An additive concentrate comprising an oil solution containing from 3 to 75 wt. % polyvinylester polymer or copolymer containing at least 25 wt. % of repeating n-alkyl ester monomer units represented by the general formula

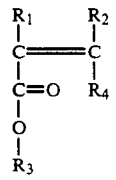

wherein $R_1$ and $R_2$ are independently hydrogen or methyl, $R_4$ is $COOR_3$, and $R_3$ is independently n-alkyl which (i) has an average number of carbon atoms from 12 to 20, and (ii) contains a methyl branch at the 1 or 2 position, and wherein on more than 10 wt. % of the ester monomer units contain alkyl groups containing more than 20 carbon atoms and no more than 20 wt. % of the ester monomer units contain alkyl groups containing fewer than 12 carbon atoms.

8. An additive concentrate according to claim 7 wherein said polymer or copolymer is a copolymer of fumarate ester and vinyl acetate.

9. An additive concentrate according to claim 7 wherein said polymer or copolymer has a molecular weight of 1,000 to 100,000.

10. An additive concentrate according to claim 7 also containing polyoxyethylene ester, ether or ester/ether.

11. An additive concentrate according to claim 7 also containing ethylene unsaturated ester copolymer flow improver.

12. The additive concentrate according to claim 7 wherein no more than 10 wt. % of said alkyl groups $R_3$ of said ester monomer units contain more branching than a methyl branch at the 1 or 2 position.

13. A distillate petroleum fuel oil boiling in the range of 120° C. to 500° C. containing from 0.0001 to 5 wt. % of an additive comprising polyvinylester polymer or copolymer comprised of repeating ester monomer units of mono-ethylenically unsaturated $C_3$–$C_4$ dicarboxylic acid esterified with at least one n-alkyl group wherein (A) at least 25 wt. % of the total monomer units of said polymer or copolymer are ester monomers having esterifying alkyl groups characterized by (i) a methyl branch at the 1 or 2 position of a straight chain alkyl group, (ii) an average number of carbon atoms of from 12 to 20, and (iii) having no more than 10 weight % of said esterifying alkyl groups containing more than 20 carbon atoms, and no more than 20 weight % of said esterifying alkyl groups containing fewer than 12 carbon atoms, and (B) no more than 10 weight % of the esterifying alkyl groups of the ester monomer units contain more branching than possessed by the esterifying alkyl groups of (A) (i).

* * * * *